US009303396B1

(12) United States Patent
Pernici et al.

(10) Patent No.: US 9,303,396 B1
(45) Date of Patent: Apr. 5, 2016

(54) URINAL SCREENS

(71) Applicants: Thomas P. Pernici, Shreveport, LA (US); T. Scott Pernici, Shreveport, LA (US)

(72) Inventors: Thomas P. Pernici, Shreveport, LA (US); T. Scott Pernici, Shreveport, LA (US)

( * ) Notice: Subject to any disclaimer, the term of this patent is extended or adjusted under 35 U.S.C. 154(b) by 130 days.

(21) Appl. No.: 14/224,234

(22) Filed: Mar. 25, 2014

(51) Int. Cl.
*E03C 1/26* (2006.01)
*E03D 13/00* (2006.01)

(52) U.S. Cl.
CPC ..... *E03D 13/005* (2013.01); *E03C 1/26* (2013.01)

(58) Field of Classification Search
CPC ..... E03C 1/264
USPC ..... 4/286–295
See application file for complete search history.

(56) References Cited

U.S. PATENT DOCUMENTS 1,494,882 A * 5/1924 Barger ..... E03C 1/264 4/292
2,094,286 A * 9/1937 Vogt ..... E03C 1/264 4/292
2,598,543 A * 5/1952 Hoffman ..... E03D 9/00 210/471
2,718,013 A * 9/1955 Rajnicek ..... E03D 13/00 4/292
2,813,631 A * 11/1957 Odman ..... E03D 9/00 210/238
2,974,324 A * 3/1961 Lundelius ..... E03D 9/00 4/256.1
3,161,360 A * 12/1964 Levine ..... E03C 1/2665 210/232
3,170,169 A * 2/1965 Clark ..... E03C 1/26 209/397
3,702,013 A * 11/1972 Gebert ..... E03C 1/26 4/288
3,760,429 A * 9/1973 Brownstein ..... E03D 13/005 4/222
5,546,614 A * 8/1996 King, II ..... E03C 1/264 210/497.1
8,590,784 B1 * 11/2013 Pernici ..... G06K 5/00 235/380
8,763,170 B1 * 7/2014 Ungarsohn ..... E03C 1/262 4/292
2009/0025128 A1 * 1/2009 Chong ..... E03C 1/264 4/292

* cited by examiner

*Primary Examiner* — Lori Baker
(74) *Attorney, Agent, or Firm* — R. Keith Harrison

(57) ABSTRACT

Urinal screens include a urinal screen panel sized and configured for placement in a restroom urinal and a self-standing screen lift handle upward-standing from the urinal screen panel.

27 Claims, 9 Drawing Sheets

URINAL SCREENS

FIELD

Illustrative embodiments of the disclosure generally relate to restroom urinals. More particularly, illustrative embodiments of the disclosure relate to urinal screens which can be quickly and easily replaced in a restroom urinal in a sanitary manner.

BACKGROUND

The background description provided herein is solely for the purpose of generally presenting the context of the illustrative embodiments of the disclosure. Aspects of the background description are neither expressly nor impliedly admitted as prior art against the claimed subject matter.

Urinals in men's restrooms typically have a replaceable urinal screen which covers the urinal drain. Throughout use of the urinal, the urinal screen collects cigarette butts, chewing tobacco, chewed gum, paper or wrappers and other solid debris. Each time the urinal is flushed, screen openings or slits in the urinal screen facilitate the passage of fluid from the urinal into the urinal drain while the screen prevents the debris from entering and clogging the drain.

The urinal screens in the urinals of many public restrooms may be replaced periodically. Accordingly, janitorial personnel typically extend their gloved hands into the water above the urinal screen in the urinal and grasp and lift the screen from the urinal with the debris remaining on the screen, after which the screen and debris are discarded in a suitable disposal container. A replacement urinal screen is then placed in the urinal over the urinal drain. However, this replacement technique is unsanitary since the personnel is typically required to immerse his hands into the water to grasp and lift the urinal screen from the urinal. Moreover, the debris which is collected from the urinal may have a tendency to inadvertently fall from the screen as it is transferred from the urinal to the disposal container. Additionally, some urinal screens may have a tendency to float in the urinal upon flushing, causing the screens to become inadvertently misplaced in the urinal when the fluid drains. Consequently, the urinal drain may be exposed and debris may enter and clog the drain.

Therefore, urinal screens which can be quickly and easily replaced in a restroom urinal in a sanitary manner are needed.

SUMMARY

Illustrative embodiments of the disclosure are generally directed to urinal screens which can be quickly and easily replaced in a restroom urinal in a sanitary manner. An illustrative embodiment of the urinal screens includes a urinal screen panel sized and configured for placement in a restroom urinal and a self-standing screen lift handle upward-standing from the urinal screen panel.

BRIEF DESCRIPTION OF THE DRAWINGS

Illustrative embodiments will now be described, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Figure 1:
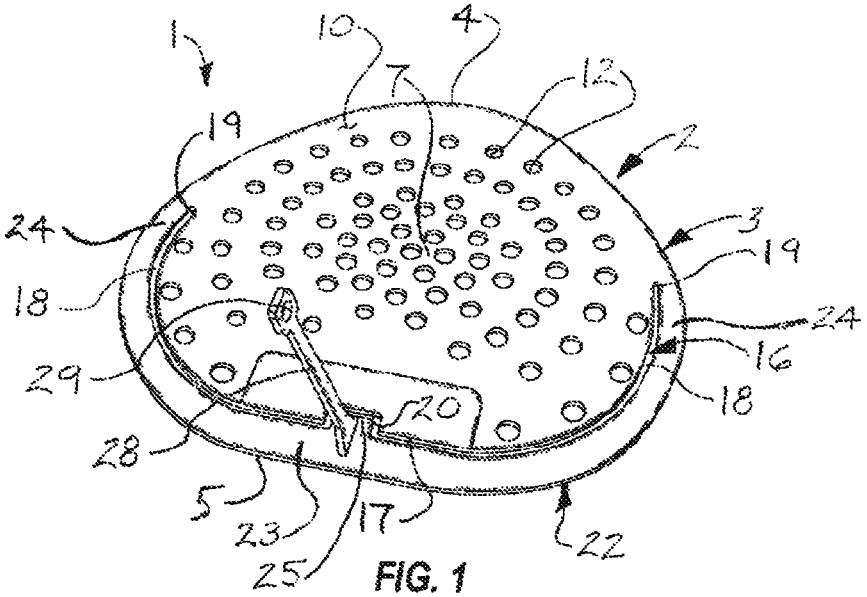
FIG. 1 is a front perspective view of an illustrative embodiment of the urinal screens deployed in a urinal drain covering configuration.
Figure 2:
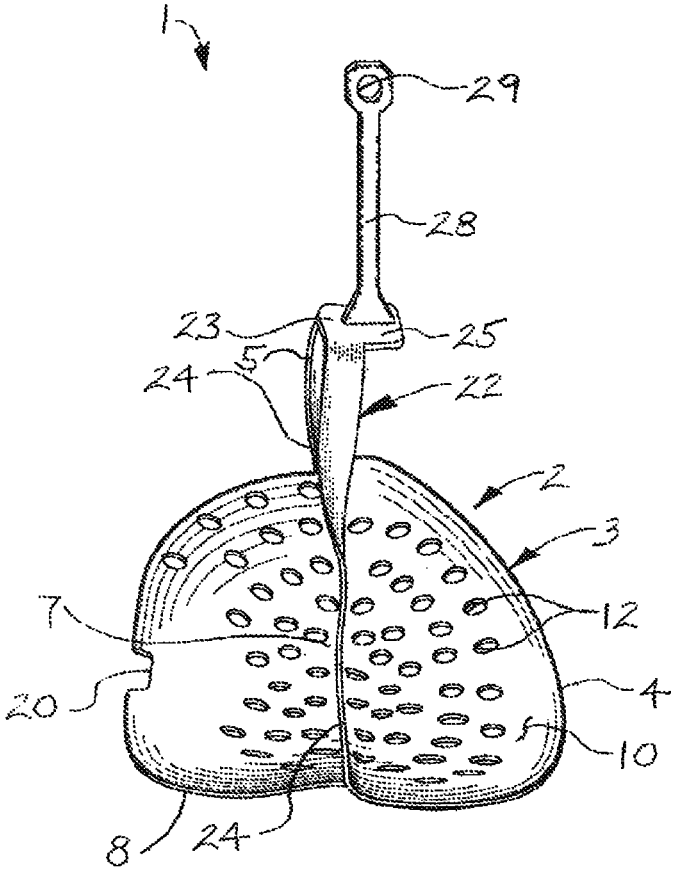
FIG. 2 is a side perspective view of the illustrative urinal screen deployed in a lifted configuration.
Figure 3:
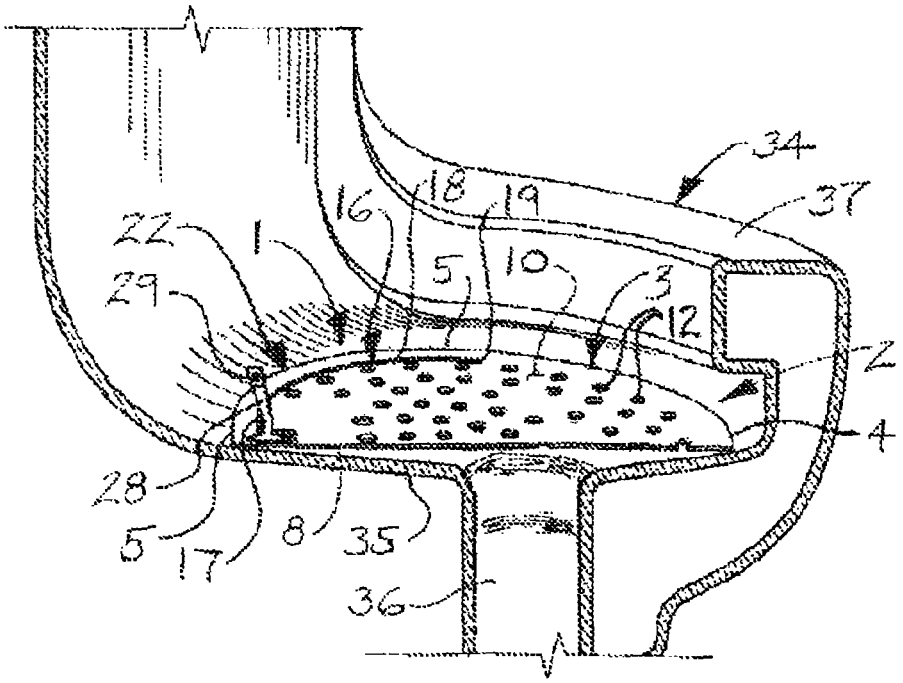
FIG. 3 is a sectional view of a restroom urinal and the illustrative urinal screen deployed in the urinal in the urinal drain covering configuration.

Referring initially to FIGS. 1-3 of the drawings, an illustrative embodiment of the urinal screens is generally indicated by reference numeral 1. The urinal screen 1 includes a urinal screen panel 2 which is sized and configured for placement in a restroom urinal. In some embodiments, for example and without limitation, the urinal screen panel 2 may have a width of from about 6" to about 8". The urinal screen panel 2 may have a generally flat or planar lower panel surface 8 and a generally flat or planar upper panel surface 10. The urinal screen panel 2 may be fabricated using materials and techniques which are known by those skilled in the art as suitable for fabrication of urinal screens. Such materials and techniques are well known to those skilled in the art. In some embodiments, the urinal screen panel 2 may include a flexible or semi-flexible molded rubber, plastic and/or other material which is impervious to liquids and may be resistant to acids, caustic agents, cleaning and deodorant compounds and the like. The urinal screen panel 2 may be molded or may be cut or stamped from a sheet of rubber, plastic and/or other material according to the knowledge of those skilled in the art.

The urinal screen panel 2 includes a main panel portion 3 and a flexible and deformable lift strap portion 22. The main panel portion 3 may have a main panel portion edge 4 and a panel center of gravity 7. Multiple screen openings 12 may extend through the main panel portion 3 from the lower panel surface 8 to the upper panel surface 10 in a selected number and pattern. The lift strap portion 22 extends from the main panel portion 3 of the urinal screen panel 2 and may have a lift strap portion edge 5 which extends in a continuous and uninterrupted transition front the main panel portion edge 4 of the main panel portion 3. In some embodiments, the lift strap portion 22 may have a generally straight front strap portion segment 23 and a pair of generally curved side strap portion segments 24 which extend from opposite ends of the front strap portion segment 23. The side strap portion segments 24 of the lift strap portion 22 may be molded or otherwise integrally formed in one piece with the main panel portion 3 or may be fabricated separately and attached to the main panel portion 3 using a suitable attachment technique known by those skilled in the art. In exemplary application, which will be hereinafter described, the urinal screen 1 can be selectively deployed in a functional, generally flat urinal drain covering configuration in which the lift strap portion 22 and the main panel portion 3 of the urinal screen panel 2 are disposed in generally coplanar relationship to each other, as illustrated in FIG. 1. The urinal screen 1 can be selectively raised from the functional urinal drain covering configuration to a lifted configuration in which the lift strap portion 22 extends upwardly and in perpendicular relationship to the main panel portion 3, which assumes a generally concave or scooped configuration, as illustrated in FIG. 2.

As illustrated in FIG. 1, a panel slot 16 may extend through the urinal screen panel 2 from the lower panel surface 8 to the upper panel surface 10. The panel slot 16 separates the front strap portion segment 23 and the side strap portion segments 24 of the lift strap portion 22 from the main panel portion 3. Accordingly, the panel slot 16 may include a generally straight front slot segment 17 which is generally adjacent and parallel to the front strap portion segment 23 of the lift strap portion 22 and a pair of generally curved side slot segments 18 which extend from the front slot segment 17 and are generally adjacent and parallel to the respective side strap portion segments 24 of the lift strap portion 22. The side slot segments 18 of the panel slot 16 may terminate at a pair of slot ends 19 which correspond to points of attachment between the side strap portion segments 24 and the main panel portion 3 and are substantially collinear, or lie along a common straight line, with the panel center of gravity 7 of the main panel portion 3.

In some embodiments, a handle tab slot 20 may be provided in the main panel portion 3 of the urinal screen panel 2. A handle tab 25 may extend from the front strap portion segment 23 of the lift strap portion 22. When the lift strap portion 22 is deployed in the urinal drain covering configuration, as illustrated in FIG. 1, the handle tab 25 may insert into the handle tab slot 20.

A self-standing screen lift handle 28 is upward-standing from the front strap portion segment 23 and the handle tab 25 of the lift strap portion 22. The screen lift handle 28 may be single-stranded and may have a long axis which is disposed in generally perpendicular relationship to the plane of the urinal screen panel 2 when the urinal screen panel 2 is deployed in the functional drain-covering configuration. The screen lift handle 28 may include any material or combination of materials which impart sufficient rigidity to the screen lift handle such that the screen lift handle 28 stands vertically when the urinal screen panel 2 is deployed in a flat or generally flat horizontal plane. In some embodiments, a handle opening 29 may extend through the distal or extending end portion of the screen lift handle 28 for purposes which will be hereinafter described. The screen lift handle 28 may be attached to the lift strap portion 22 of the urinal screen panel 2 according to any suitable technique which is known by those skilled in the art such as via molding or insertion through an opening (not illustrated) in the lift strap portion 22, for example and without limitation.

As illustrated in FIG. 3, in exemplary application, the urinal screen 1 is placed in a restroom urinal 34 to cover a urinal drain 36 which leads from the urinal 34. Generally, the urinal 34 may include a urinal bottom 35 and a urinal rim 37 which extends upwardly from the urinal bottom 35. The urinal screen panel 2 is placed on the urinal bottom 35 with the lower panel surface 8 of the main panel portion 3 extending over the urinal drain 36. The screen lift handle 28 extends upwardly from the lift strap portion 22 of the urinal screen panel 2 and typically protrudes above the surface of any liquid (not illustrated) which may remain standing or pooling in the urinal 34 between flushes.

Throughout use of the urinal 34, solid debris (not illustrated) such as cigarette butts, chewing tobacco, chewed gum, paper or plastic wrappers and the like may be discarded into the urinal 34. As the urinal 34 is flushed, the liquid in the urinal 34 drains through the screen openings 12 to the underling urinal drain 36, whereas the solid debris typically settles on the upper panel surface 10 of the main panel portion 3 such that it does not enter and clog the urinal drain 36. After prolonged use of the urinal 34, the urinal screen panel 2 may gradually corrode due to the presence of acids, caustic agents, cleaning and deodorant compounds and the like in the urinal 34. Therefore, urinal screens 1 may require regular replacement in the urinal 34.

Accordingly, janitorial personnel (not illustrated) may don a rubber glove, pinch the upper protruding portion of the screen lift handle 28 typically between two fingers of the gloved hand and lift the screen lift handle 28 straight upwardly. Alternatively, a rod, wire, stick or other object (not illustrated) may be inserted through the handle opening 29 in the screen lift handle 28 and raised to lift the screen lift handle 28. Thus, the lift strap portion 22 of the urinal screen panel 2 becomes deformed where the side strap segments 24 join the main panel portion 3 and the urinal screen 1 assumes the lift configuration illustrated in FIG. 2, such that the lift strap portion 22 is disposed in generally perpendicular relationship to the main panel portion 3 with the screen lift handle 28 directly above the panel center of gravity 7 and the main panel portion 3 assumes the concave, scooped configuration. Therefore, the solid debris which previously settled on the upper panel surface 10 of the main panel portion 3 throughout repeated use of the urinal 34 is scooped up and cradled or confined within the concave main panel portion 3 as the screen lift handle 28 is raised to first lift then and transfer the urinal screen 1 and the solid debris carried therein to a suitable disposal container (not illustrated). A replacement urinal screen 1 may then be deployed in the drain covering configuration (FIG. 1) in the urinal 34 for use and may eventually be replaced in like manner.

It will be appreciated by those skilled in the art that the urinal screen 1 can be quickly and easily replaced in a urinal 34 in a sanitary manner. The upward-standing screen lift handle 28 minimizes contact between the urinal screen 1 and the hands of the janitorial personnel who is effecting the replacement. Moreover, the solid debris which accumulates on the urinal screen 1 can be easily removed from the urinal 34 and discarded with the urinal screen 1 in one step. In the lift configuration of the urinal screen 1 (FIG. 2), the screen lift handle 28 remains substantially directly above and the side strap portion segments 24 remain on opposite sides of the center of gravity 7 of the main panel portion 3. This expedient ensures that the main panel portion 3 remains in a substantially level orientation as the urinal screen 1 and debris are transferred from the urinal 34 to the disposal container. The urinal screen 1 can be fabricated using conventional urinal screen fabrication materials and techniques known by those skilled in the art. According to some fabrication methods, the urinal screen panel 2 can be molded in one piece or cut or stamped from a sheet, after which the panel slot 16 can be cut or stamped to form the main panel portion 3 and the lift strap portion 22. Alternatively, the main panel portion 3 and the lift strap portion 22 can be molded together in one step. The screen lift handle 28 may include the same material or combination of materials as the urinal screen panel 2 and may be fabricated integrally with the lift strap portion 22 or separately fabricated and then attached to the lift strap portion 22 using any suitable fastening technique known by those skilled in the art.

Figure 4:
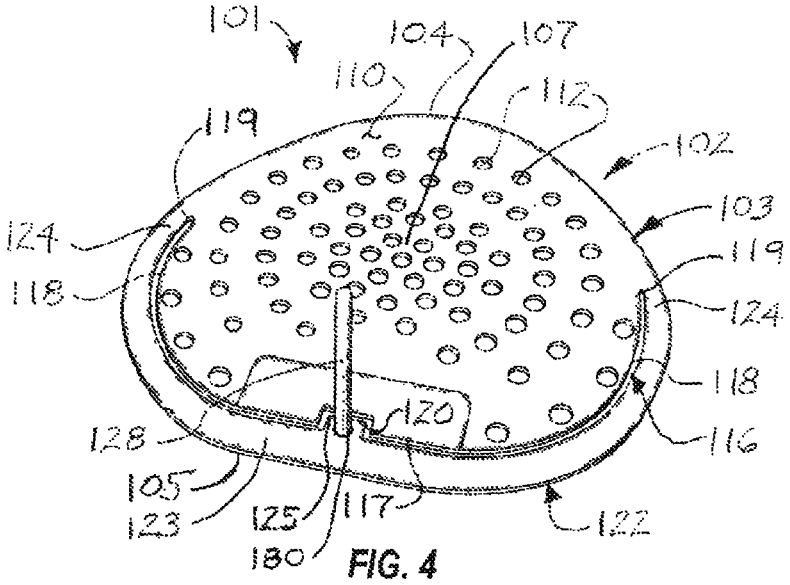
FIG. 4 is a front perspective view of an alternative illustrative embodiment of the urinal screens.

Referring next to FIG. 4 of the drawings, an alternative illustrative embodiment of the urinal screens is generally indicated by reference numeral 101. In the urinal screen 101, elements which are analogous to the respective elements of the urinal screen 1 that was heretofore described with respect to FIGS. 1-3 are designated by the same numeral in the 101-199 series in FIG. 4. The urinal screen 101 may have a design which is the same as that of the urinal screen 1 except the screen lift handle 128 may include plastic, metal, wood and/or other material to render the screen lift handle 128 self-standing on the lift strap portion 122. The screen lift handle 128 may extend through a handle insertion opening 180 in the handle tab 125. The screen lift handle 128 may be single-stranded and may have a long axis which is disposed in generally perpendicular relationship to the plane of the urinal screen panel 102 when the urinal screen panel 102 is deployed in the functional drain covering configuration. Application of the urinal screen 101 may be as was heretofore described with respect to application of the urinal screen 1.

Figure 5:
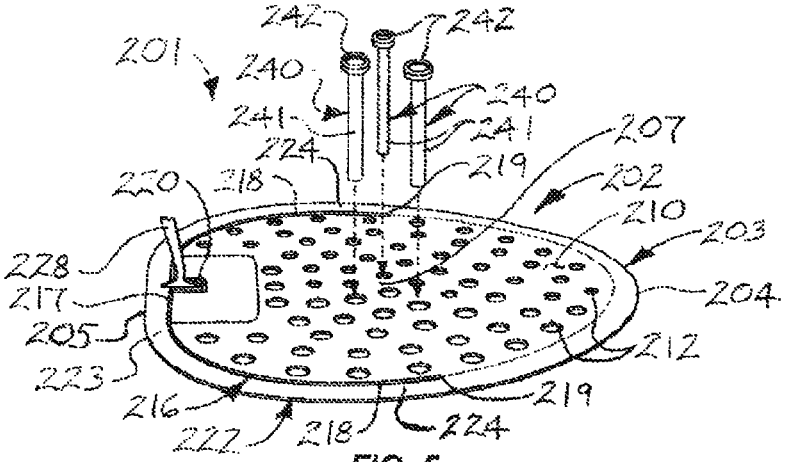
FIG. 5 is an exploded side perspective view of another alternative illustrative embodiment of the urinal screens, more particularly illustrating insertion of multiple screen centralizing pegs through respective screen openings in the urinal screen.
Figure 6:
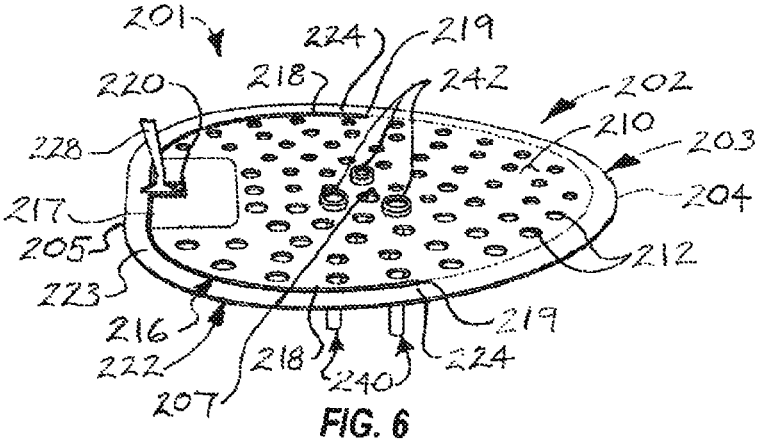
FIG. 6 is a side perspective view of the illustrative urinal screen illustrated in FIG. 5 with the screen centralizing pegs seated in the respective screen openings.
Figure 7:
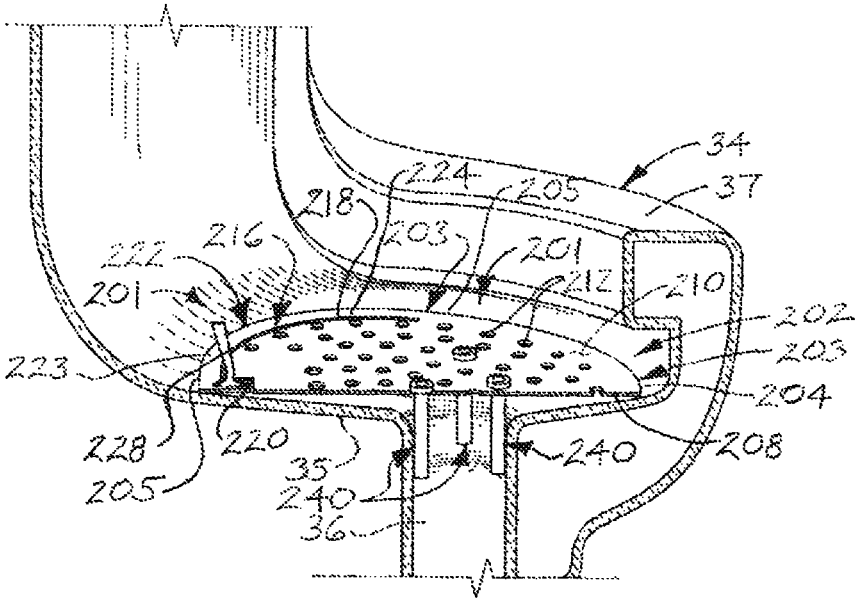
FIG. 7 is a sectional view of a restroom urinal with the illustrative urinal screen of FIG. 6 deployed in the urinal in the urinal drain covering configuration.

Referring next to FIGS. 5-7 of the drawings, another alternative illustrative embodiment of the urinal screens is generally indicated by reference numeral 201. In the urinal screen 201, elements which are analogous to the respective elements of the urinal screen 1 that was heretofore described with respect to FIGS. 1-3 are designated by the same numeral in the 201-299 series in FIGS. 5-7. At least one screen centralizing peg 240 may extend from the lower panel surface 208 of the main panel portion 203 at or near the geometric center of the main panel portion 203. In some embodiments, at least one screen centralizing peg 240 may be inserted through at least one of the screen openings 212 in the main panel portion 203 of the urinal screen panel 202. In some embodiments, multiple screen centralizing pegs 240 may be inserted through respective screen openings 212 which are grouped together in the center portion of the main panel portion 203. Each screen centralizing peg 240 may include a generally elongated peg shaft 241 and a peg head 242 on the peg shaft 241. Accordingly, each screen centralizing peg 240 may be seated in a corresponding screen opening 212 by inserting the peg shaft 241 through the screen opening 212 and seating the peg head 242 against the upper panel surface 210 of the main panel portion 203. Alternatively, each screen centralizing peg 240 may be molded or otherwise fabricated or attached to the urinal screen panel 202 according to the knowledge of those skilled in the art.

As illustrated in FIG. 7, in exemplary application of the urinal screen 201, the urinal screen panel 202 is deployed in the functional drain-covering configuration in the urinal 34 to cover the urinal drain 36 throughout use of the urinal 34, as was heretofore described with respect to the urinal screen 1. The screen centralizing pegs 240 extend into the urinal drain 36. Accordingly, during flushing of the urinal 34, the urinal screen panel 202 may have a tendency to float and shift in the rising liquid in the urinal 34. After the liquid drains through the urinal drain 36 and subsides in the urinal 34, the urinal screen 201 may therefore become repositioned on the urinal bottom 35 such that the urinal screen 201 no longer adequately covers the urinal drain 36. Therefore, the screen centralizing pegs 240 engage the interior sides of the urinal drain 36 to maintain the urinal screen 201 in a central position on the urinal bottom 35 as the urinal 34 is flushed such that the urinal screen 201 optimally covers the urinal drain 36 and prevents solid debris from entering and clogging the urinal drain 36. After prolonged use of the urinal 34, the urinal screen 201 may be replaced in the urinal 34 typically in the same manner as was heretofore described with respect to the urinal screen 1 in FIGS. 1-3.

Figure 8:
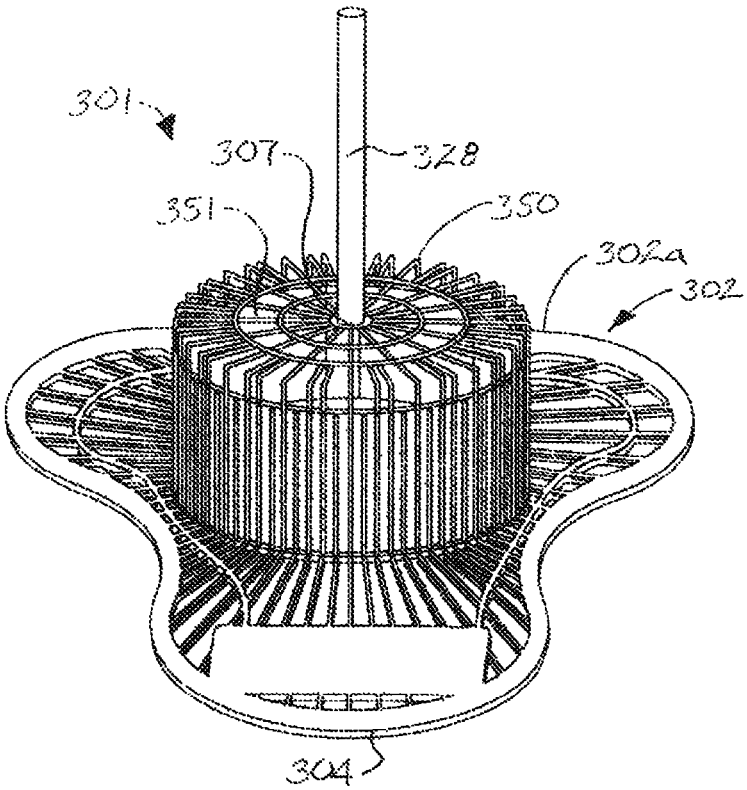
FIG. 8 is a perspective view of another alternative illustrative embodiment of the urinal screens.

Referring next to FIG. 8 of the drawings, another alternative illustrative embodiment of the urinal screens is generally indicated by reference numeral 301. In the urinal screen 301, elements which are analogous to the respective elements of the urinal screen 1 that was heretofore described with respect to FIGS. 1-3 are designated by the same numeral in the 301-399 series in FIG. 8. The urinal screen panel 302 of the urinal screen 301 may have an irregularly-shaped screen panel edge **302*a*. A central cake cage 350 extends upwardly from the urinal screen panel 302. The cake cage 350 contains a deodorant cake 351. The center of gravity 307 of the urinal screen panel 302 may located at generally the center of the cake cage 350. A self-standing screen lift handle 328 is upward-standing from the cake cage 350 generally at the panel center of gravity 307. The screen lift handle 328 may be single-stranded and may have a long axis which is disposed in generally perpendicular relationship to the plane of the urinal screen panel 302 when the urinal screen panel 302** is deployed in the functional drain covering configuration.

Exemplary application of the urinal screen 301 may be as was heretofore described with respect to the urinal screen 1 in FIGS. 1-3. When the urinal screen 301 is deployed in the urinal 34 (FIG. 3), the screen lift handle 328 protrudes upwardly through the standing liquid which pools in the urinal 34 (FIG. 3) such that janitorial personnel need only pinch the protruding end portion of the screen lift handle 328 with two fingers and lift the screen lift handle 328 to first remove the urinal screen 301 from the urinal 34 and then transfer the urinal screen 301 to a suitable disposal container (not illustrated).

Figure 9:
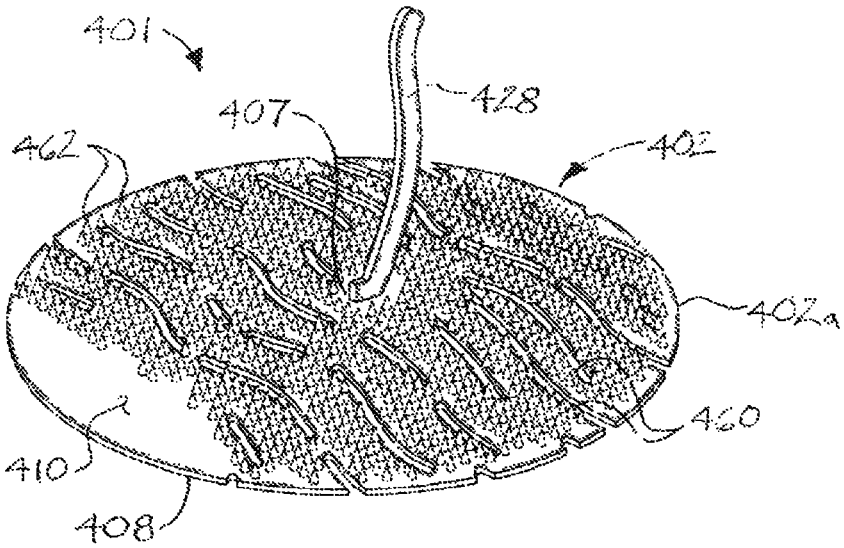
FIG. 9 is a perspective view of yet another alternative illustrative embodiment of the urinal screens.

Referring next to FIG. 9 of the drawings, another alternative illustrative embodiment of the urinal screens is generally indicated by reference numeral 401. In the urinal screen 401, elements which are analogous to the respective elements of the urinal screen 1 that was heretofore described with respect to FIGS. 1-3 are designated by the same numeral in the 401-499 series in FIG. 9. The urinal screen 401 includes a urinal screen panel 402 having a screen panel edge 402*a* which may be generally circular in some embodiments. Multiple screen slots 460 may extend through the urinal screen panel 402. Multiple screen panel protrusions 462 may extend from the upper panel surface 410 of the urinal screen panel 402. A self-standing screen lift handle 428 is upward-standing from the upper panel surface 410 at the panel center of gravity 407 of the urinal screen panel 402. The screen lift handle 428 may be single-stranded and may have a long axis which is disposed in generally perpendicular relationship to the plane of the urinal screen panel 402 when the urinal screen panel 402 is deployed in the functional drain covering configuration in a urinal 34 (FIG. 3).

Exemplary application of the urinal screen 401 may be as was heretofore described with respect to the urinal screen 1 in FIGS. 1-3. The screen lift handle 428 protrudes upwardly through the standing liquid which pools the urinal 34 (FIG. 3) such that janitorial personnel need only pinch the protruding end portion of the screen lift handle 428 with two fingers and lift the screen lift handle 428 to remove the urinal screen 401 from the urinal 34 and transfer the urinal screen 401 and solid debris to a suitable disposal container (not illustrated).

Figure 10:
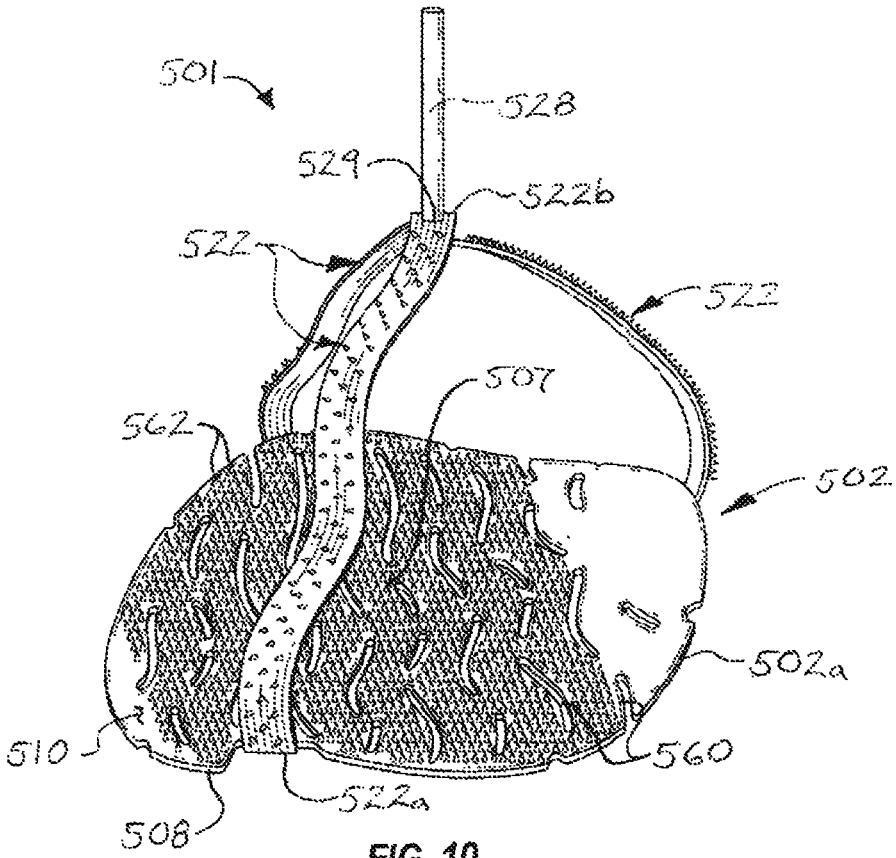
FIG. 10 is a perspective view of still another alternative illustrative embodiment of the urinal screens.

Referring next to FIG. 10 of the drawings, still another alternative illustrative embodiment of the urinal screens is generally indicated by reference numeral 501. In the urinal screen 501, elements which are analogous to the respective elements of the urinal screen 401 that was heretofore described with respect to FIG. 9 are designated by the same numeral in the 401-499 series in FIG. 10. The urinal screen 501 may include at least two lift strap portions 522 each of which has a panel attachment end 522*a* attached to the urinal screen panel 502 and a handle attachment end 522*b* opposite the panel attachment end 522*a*. In embodiments in which two lift strap portions 522 extend from the urinal screen panel 502, the panel attachment ends 522*a* of the respective lift strap portions 522 may be attached to the screen panel edge 502*a* of the urinal screen panel 502 in generally diametrically-opposed relationship to each other. In embodiments in which three or more lift strap portions 522 extend from the urinal screen panel 502, the panel attachment ends 522*a* of the respective lift strap portions 522 may be attached to the urinal screen panel 502 in generally equally-spaced relationship to each other around the screen panel edge 502*a*, as illustrated. A self-standing screen lift handle 528 is upward-standing from the handle attachment ends 522*b* of the lift strap portions 522 substantially above the panel center of gravity 507. The screen lift handle 528 may be single-stranded and may have a long axis which is disposed in generally perpendicular relationship to the plane of the urinal screen panel 502 when the urinal screen panel 502 is deployed in the functional drain covering configuration in a urinal 34 (FIG. 3). In some embodiments, the screen lift handle 528 may extend through registering handle insertion openings 580 in the overlapping handle attachment ends 522*b* of the respective lift strap portions 522. Accordingly, the urinal screen 501 can be selectively deployed in a functional, flat urinal drain covering configuration in which the urinal screen panel 502 is disposed in a generally flat, coplanar configuration and a lifted configuration in which the lift strap portions 522 extend upwardly and the main panel portion 3 assumes a generally concave or scooped configuration, as illustrated in FIG. 10.

Exemplary application of the urinal screen 501 may be as was heretofore described with respect to the urinal screen 1 in FIGS. 1-3. Accordingly, when the urinal screen 501 is deployed in the urinal drain covering configuration in the urinal 34 (FIG. 3), solid debris (not illustrated) accumulates on the upper panel surface 510 of the urinal screen panel 502. When the urinal screen 1 is raised from the urinal 34 by lifting of the screen lift handle 528, the urinal screen panel 502 assumes the concave or scooped configuration such that the solid debris is cradled in the urinal screen panel 502 as the urinal screen 501 is transferred to the disposal container (not illustrated). A replacement urinal screen 501 may then be placed in the urinal 34.

Figure 11:
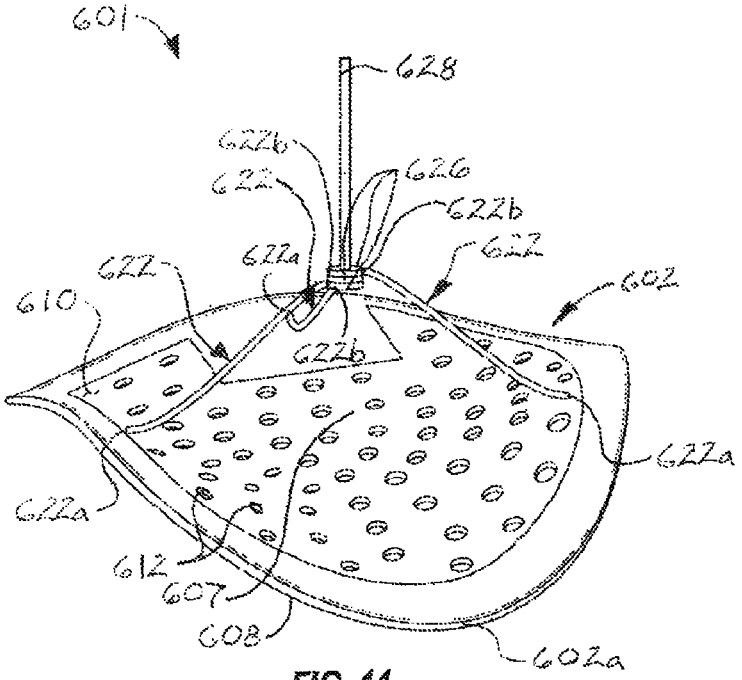
FIG. 11 is a perspective view of another alternative illustrative embodiment of the urinal screens.

Referring next to FIG. 11 of the drawings, another alternative illustrative embodiment of the urinal screens is generally indicated by reference numeral 601. In the urinal screen 601, elements which are analogous to the respective elements of the urinal screen 501 that was heretofore described with respect to FIG. 10 are designated by the same numeral in the 601-699 series in FIG. 11. The urinal screen panel 602 of the urinal screen 601 may have a shape which is the same as or different than that of the urinal screen panel 502 of the urinal screen 501 in FIG. 10. In some embodiments, the urinal screen panel 602 may have a shape which is the same as or similar to that of the urinal screen panel 2 of the urinal screen 1 which was heretofore described with respect to FIGS. 1-3. Multiple screen openings 612 may extend through the urinal screen panel 602 in a selected number and pattern. A handle eyelet 626 may terminate the handle attachment end 622*b* of each lift strap portion 622. The upward-standing screen lift handle 628 extends through the registering handle eyelets 626 on the respective lift strap portions 622 and may terminate in a handle tab (not illustrated) which retains the screen lift handle 628 in the handle eyelets 626 to attach the screen lift handle 628 to the lift strap portions 622. The screen lift handle 628 may be single-stranded and may have a long axis which is disposed in generally perpendicular relationship to the plane of the urinal screen panel 602 when the urinal screen panel 602 is deployed in the functional drain-covering configuration. Application of the urinal screen 601 may be as was heretofore described with respect to application of the urinal screen 501 in FIG. 10.

Figure 12:
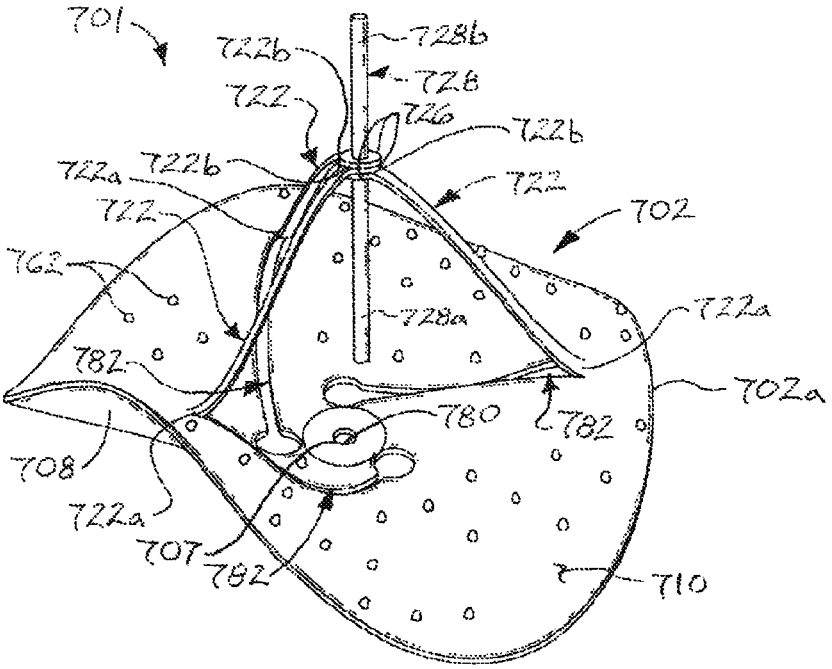
FIG. 12 is a perspective view of yet another alternative illustrative embodiment of the urinal screens.
Figure 13:
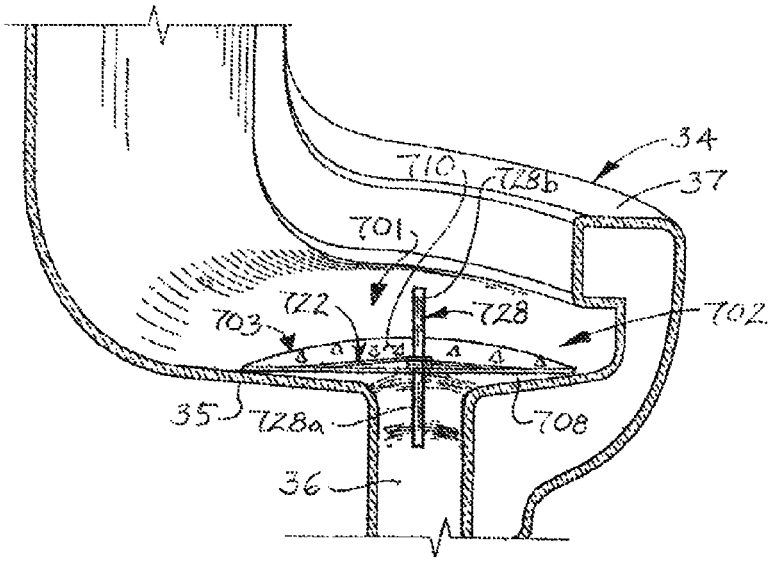
FIG. 13 is a sectional view of a restroom urinal with the illustrative urinal screen of FIG. 12 deployed in the urinal in the urinal drain covering configuration.

Referring next to FIGS. 12 and 13 of the drawings, yet another alternative illustrative embodiment of the urinal screens is generally indicated by reference numeral 701. In the urinal screen 701, elements which are analogous to the respective elements of the urinal screen 601 that was heretofore described with respect to FIG. 11 are designated by the same numeral in the 701-799 series in FIGS. 12 and 13. In some embodiments, the lift strap portions 722 and attached handle eyelets 726 may be cut from the urinal screen panel 702, forming lift strap slots 782 in the urinal screen panel 702, as illustrated. In other embodiments, the lift strap portions 722 may be separately fabricated and attached to the urinal screen panel 702 or molded, stamped or cut out of the urinal screen panel 702 or other fabricated integrally with or made separately and attached to the urinal screen panel 702 according to the knowledge of those skilled in the art.

The screen lift handle 728 of the urinal screen 701 may have a drain insertion segment 728*a* and a lift segment 728*b*. The handle eyelets 726 on the handle attachment ends 722*b* of the respective lift strap portions 722 may be attached to the screen lift handle 728 between the drain insertion segment 728*a* and the lift segment 728*b* according to any suitable attachment technique known by those skilled in the art. A handle insertion opening 780 extends through the urinal screen panel 702 at the panel center of gravity 707. As illustrated in FIG. 13, when the urinal screen 701 is deployed in the functional urinal drain covering configuration in a urinal 34, the drain insertion segment 728*a* of the screen lift handle 728 extends downwardly through the handle insertion opening 780 into the underlying urinal drain 36 and centralizes the urinal screen 701 over the urinal drain 36. The handle eyelets 726 stack against the upper panel surface 710, whereas the lift segment 728*b* of the screen lift handle 728 protrudes upwardly beyond the upper panel surface 710 above the pooled liquid in the urinal 34. The lift segment 728*b* of the screen lift handle 728 may be single-stranded and may have a long axis which is disposed in generally perpendicular relationship to the plane of the urinal screen panel 702 when the urinal screen panel 702 is deployed in the functional drain-covering configuration. Accordingly, throughout use of the urinal 34, solid debris accumulates on the upper panel surface 710 as the urinal screen panel 702 covers the urinal drain 36. The urinal screen 701 can be selectively lifted from the urinal 34, transferred to a disposal container (not illustrated) and discarded along with the solid debris cradled therein by grasping and raising of the lift segment 728*b* of the screen lift handle 728. Thus, the drain insertion segment 728*a* of the screen lift handle 728 is removed from the handle insertion opening 780 as the urinal screen panel 702 assumes the concave scoop shape as illustrated in FIG. 12.

Figure 13A:
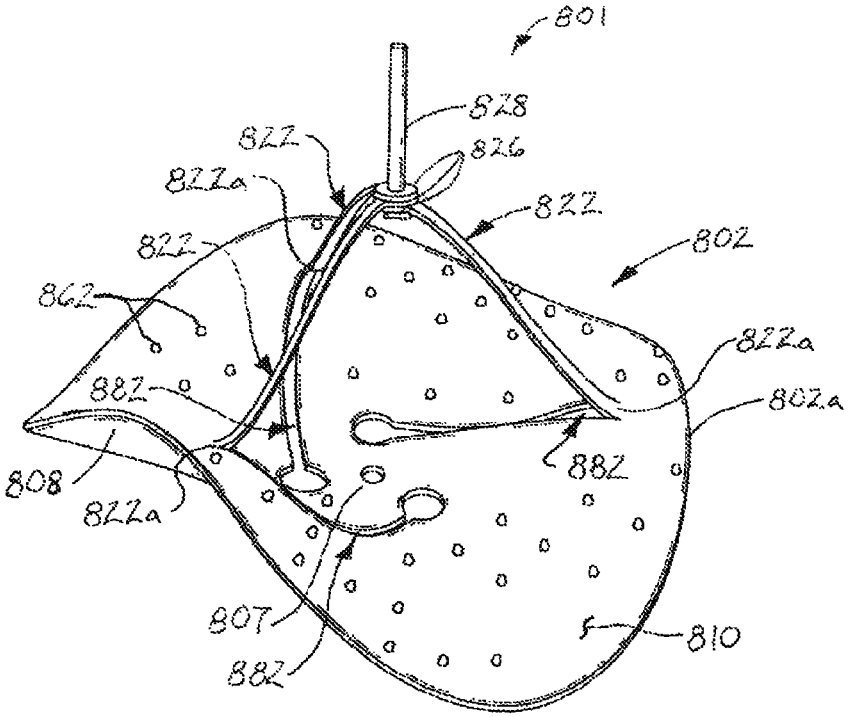
FIG. 13A is a perspective view of still another alternative illustrative embodiment of the urinal screens.

Referring next to FIG. 13A of the drawings, still another alternative illustrative embodiment of the urinal screens is generally indicated by reference numeral 801. In the urinal screen 801, elements which are analogous to the respective elements of the urinal screen 701 that was heretofore described with respect to FIGS. 12 and 13 are designated by the same numeral in the 801-899 series in FIG. 13A. The screen lift handle 828 of the urinal screen 801 may lack the drain insertion segment 728*a* which was heretofore described with respect to the screen lift handle 728 of the urinal screen 701 in FIGS. 12 and 13. Thus, when the urinal screen 801 is deployed in the functional urinal screen covering configuration, the screen lift handle 828 may rest on the upper panel surface 810 of the urinal screen panel 802 instead of having the drain insertion segment 728*a* which extends through a handle insertion opening 780 at the panel center of gravity 807, as was heretofore described with respect to the urinal screen 701 in FIGS. 12 and 13. The screen lift handle 828 may be single-stranded and may have a long axis which is disposed in generally perpendicular relationship to the plane of the urinal screen panel 802 when the urinal screen panel 802 is deployed in the functional drain-covering configuration. Application of the urinal screen 801 may be as was heretofore described with respect to the urinal screen 701 in FIG. 13, without the centralizing function of the drain insertion segment 728*a* (FIG. 12) on the screen lift handle 828.

Figure 14:
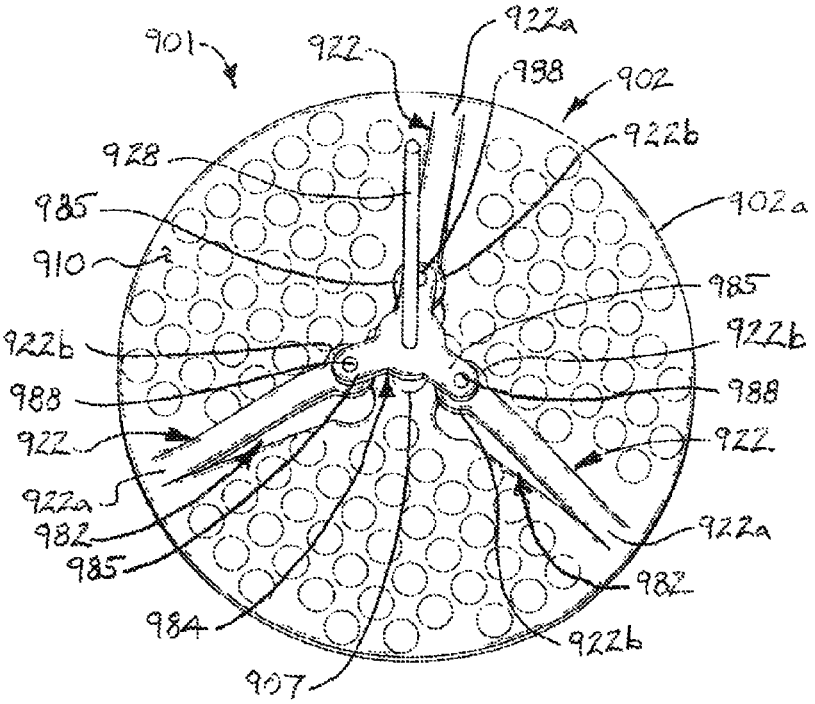
FIG. 14 is a perspective view of another alternative illustrative embodiment of the urinal screens.
Figure 15:
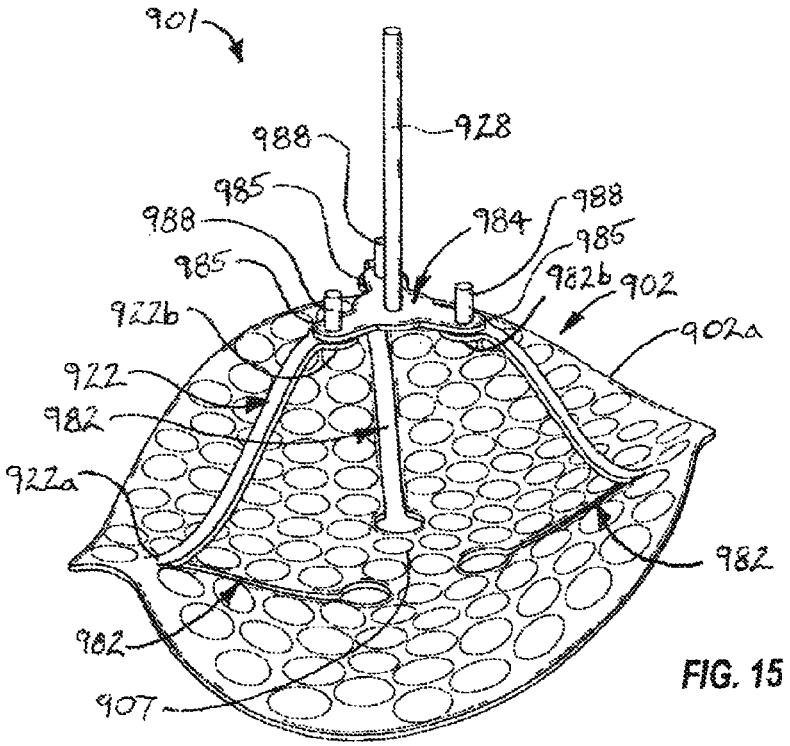
FIG. 15 is a perspective view of the illustrative urinal screen illustrated in FIG. 14, deployed in the lifted configuration.

Referring next to FIGS. 14 and 15 of the drawings, another alternative illustrative embodiment of the urinal screens is generally indicated by reference numeral 901. In the urinal screen 901, elements which are analogous to the respective elements of the urinal screen 701 that was heretofore described with respect to FIGS. 12 and 13 are designated by the same numeral in the 901-999 series in FIGS. 14 and 15. A handle base 984 may include multiple outwardly-extending handle base tabs 985. A strap tab 988 may extend from the handle attachment end 922*b* of each lift strap portion 922. Each strap tab 988 may be inserted, through a strap tab opening (not illustrated) in each corresponding handle base tab 985 to attach the handle base 984 to the lift strap portions 922. A self-standing screen lift handle 928 is upward-standing from the handle base 984. The screen lift handle 928 may be single-stranded and may have a long axis which is disposed in generally perpendicular relationship to the plane of the urinal screen panel 902 when the urinal screen panel 902 is deployed in the functional drain-covering configuration. In some embodiments, the lift strap portions 922 may be cut from the urinal screen panel 902, forming the lift strap slots 982. In other applications, the lift strap portions 922 and the urinal screen panel 902 may be individually fabricated and the lift strap portions molded or otherwise formed integrally with or attached to the urinal screen panel 902 according to the knowledge of those skilled in the art. Application of the urinal screen 901 may be as was heretofore described with respect to the urinal screen 701 in FIG. 13, without the centralizing function of the drain insertion segment 728*a* (FIG. 12) on the screen lift handle 928.

Figure 16:
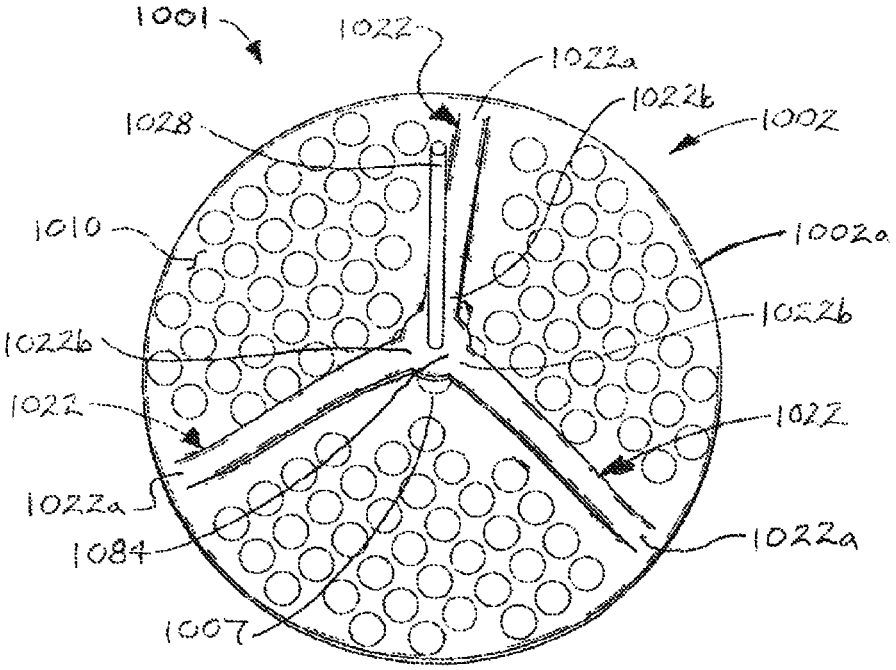
FIG. 16 is a perspective view of another alternative illustrative embodiment of the urinal screens.

Referring next to FIG. 16 of the drawings, another alternative illustrative embodiment of the urinal screens is generally indicated by reference numeral 1001. In the urinal screen 1001, elements which are analogous to the respective elements of the urinal screen 901 that was heretofore described with respect to FIGS. 14 and 15 are designated by the same numeral in the 1001-1099 series in FIG. 16. The panel attachment end 1022*a* of each lift strap portion 1022 may be fabricated separately and molded or otherwise fabricated integrally with the urinal screen panel 1002, and the handle attachment end 1022*b* of each lift strap portion 1022 may be molded or otherwise fabricated integrally with the handle base 1084 according to the knowledge of those skilled in the art. Application of the urinal screen 1001 may be as was heretofore described with respect to the urinal screen 701 in FIG. 13, without the centralizing function of the drain insertion segment 728*a* (FIG. 12) on the screen lift handle 1028.

Figure 17:
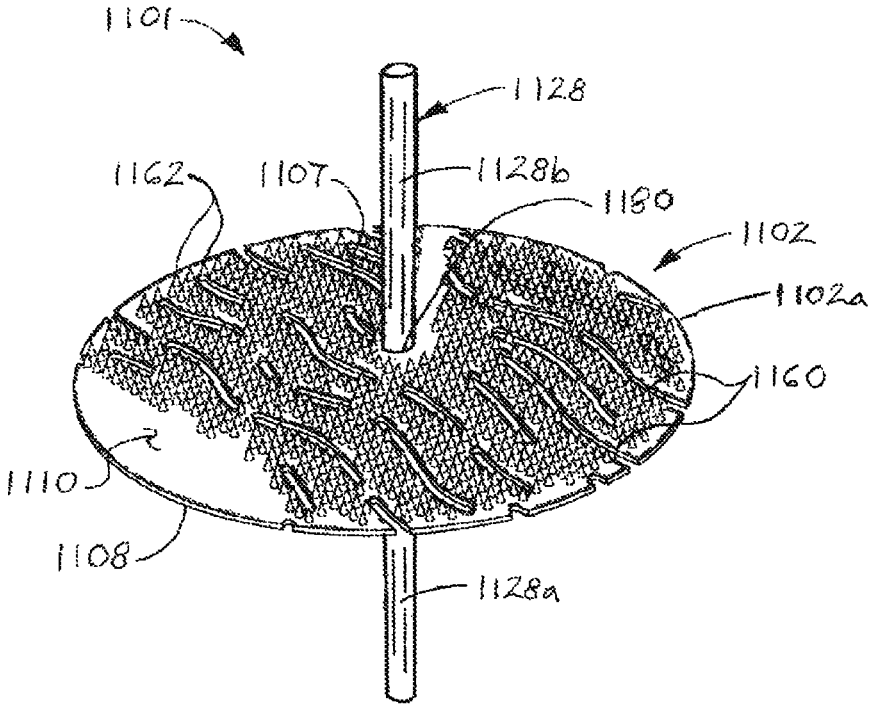
FIG. 17 is a perspective view of yet another alternative illustrative embodiment of the urinal screens.

Referring next to FIG. 17 of the drawings, yet another alternative illustrative embodiment of the urinal screens is generally indicated by reference numeral 1101. In the urinal screen 1101, elements which are analogous to the respective elements of the urinal screen 701 that was heretofore described with respect to FIGS. 12 and 13 are designated by the same numeral in the 1101-1199 series in FIG. 17. Multiple screen slots 1160 may extend through the urinal screen panel 1102. Multiple screen panel protrusions 1162 may extend from the upper panel surface 1110 of the urinal screen panel 1102. The screen lift handle 1128 may extend through a handle insertion opening 1180 at the panel center of gravity 1107 of the urinal screen panel 1102. Accordingly, a drain insertion segment 1128*a* of the screen lift handle 1128 extends beyond the lower panel surface 1108 and a self-standing lift segment 1128*b* extends beyond the upper panel surface 1110. The screen lift handle 1128 may be single-stranded and may have a long axis which is disposed in generally perpendicular relationship to the plane of the urinal screen panel 1102 when the urinal screen panel 1102 is deployed in the functional drain-covering configuration. Application of the urinal screen 1101 may be as was heretofore described with respect to the urinal FIG. 13, without the centralizing function of the drain insertion segment 1128*a* on the screen lift handle 1128.

It will be appreciated by those skilled in the art that the various embodiments of the urinal screens described herein facilitate removal of the urinal screens from a urinal along with the solid debris which is typically discarded in urinals found in public restrooms and collects on the urinal screen panel of the urinal screens. In some applications, the urinal screens may be discarded along with the debris which is scooped up on the screens in a suitable disposal container (not illustrated), as was described herein above. In other applications, the urinal screen may be removed from the urinal, suspended over a toilet from the screen lift handle while the urinal screen panel is submerged and the toilet flushed to wash the debris from the screen, after which the cleaned or rinsed screen may be replaced in the urinal for continued use. In other applications the urinal screen panel of the urinal screen may be tilted inside a disposal container to dump the debris from the urinal screen into the disposal container, after which the urinal screen is replaced in the urinal.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A urinal screen, comprising:

a urinal screen panel sized and configured for placement in a restroom urinal;

at least one lift strap portion carried by the urinal screen panel; and a screen lift handle carried by the at least one lift strap portion.

2. The urinal screen of claim 1 wherein the screen lift handle has a long axis disposed in generally perpendicular relationship to a plane of the urinal screen panel.

3. The urinal screen of claim 1 further comprising at least one screen centralizing peg carried by the urinal screen panel.

4. A urinal screen, comprising:

a urinal screen panel sized and configured for placement in a restroom urinal;

at least one lift strap portion carried by the urinal screen panel; and a self-standing screen lift handle upward-standing from the at least one lift strap portion.

5. The urinal screen of claim 4 wherein the at least one lift strap portion comprises a plurality of lift strap portions, and further comprising a plurality of handle eyelets carried by the plurality of lift strap portions, respectively, and wherein the screen lift handle extends through the plurality of handle eyelets.

6. The urinal screen of claim 5 further comprising a plurality of lift strap slots in the urinal screen panel.

7. The urinal screen of claim 5 further comprising a handle insertion opening in the urinal screen panel, and wherein the screen lift handle normally extends through the handle insertion opening.

8. The urinal screen of claim 7 wherein the screen lift handle comprises a drain insertion segment extending beyond the urinal screen panel on a first side of the handle insertion opening and a lift segment extending beyond the urinal screen panel on a second side of the handle insertion opening.

9. The urinal screen of claim 4 further comprising a handle base having a plurality of outwardly-extending handle base tabs carried by the plurality of lift strap portions, respectively, and wherein the screen lift handle is carried by the handle base.

10. The urinal screen of claim 1 further comprising a handle insertion opening in the urinal screen panel, and wherein the screen lift handle extends through the handle insertion opening.

11. The urinal screen of claim 10 wherein the screen lift handle comprises a drain insertion segment extending beyond the urinal screen panel on a first side of the handle insertion opening and a lift segment extending beyond the urinal screen panel on a second side of the handle insertion opening.

12. A urinal screen, comprising:

a urinal screen panel sized and configured for placement in a restroom urinal, the urinal screen panel including:

a main panel portion; and a flexible and deformable lift strap portion carried by the main panel portion;

a single-stranded, self-standing screen lift handle upward-standing from the lift strap portion of the urinal screen panel; and at least one screen centralizing peg carried by the urinal screen panel.

13. The urinal screen of claim 12 wherein the screen lift handle has a long axis disposed in generally perpendicular relationship to a plane of the urinal screen panel.

14. A urinal screen, comprising:

a urinal screen panel sized and configured for placement in a restroom urinal, the urinal screen panel including:

a main panel portion; and a flexible and deformable lift strap portion carried by the main panel portion;

a single-stranded, self-standing screen lift handle upward-standing from the lift strap portion of the urinal screen panel; and a panel slot separating the main panel portion and the lift strap portion of the urinal screen panel.

15. The urinal screen of claim 14 wherein the lift strap portion comprises a front strap portion segment and a pair of side strap portion segments extending from the front strap portion segment and extending from the main panel portion, and wherein the screen lift handle is upward-standing from the front strap portion segment.

16. The urinal screen of claim 15 wherein the panel slot comprises a front slot segment generally parallel to the front strap portion segment of the lift strap portion; a pair of side slot segments extending from the front slot segment and generally parallel to the pair of side strap portion segments, respectively, of the lift strap portion; and a pair of slot ends terminating the pair of side slot segments, respectively, the pair of slot ends substantially collinear with a center of gravity of the main panel portion.

17. The urinal screen of claim 15 further comprising a handle tab slot provided in the main panel portion and a handle tab extending from the front strap portion segment of the lift strap portion, the handle tab normally inserted in the handle tab slot.

18. A urinal screen, comprising:

a urinal screen panel sized and configured for placement in a restroom urinal, the urinal screen panel including:

a main panel portion; and a flexible and deformable lift strap portion carried by the main panel portion;

a single-stranded, self-standing screen lift handle upward-standing from the lift strap portion of the urinal screen panel; and a handle opening terminating the screen lift handle.

19. A urinal screen, comprising:

a urinal screen panel sized and configured for placement in a restroom urinal, the urinal screen panel including:

a main panel portion; and a flexible and deformable lift strap portion carried by the main panel portion;

a single-stranded, self-standing screen lift handle upward-standing from the lift strap portion of the urinal screen panel; and at least one screen centralizing peg carried by the main panel portion of the urinal screen panel.

20. The urinal screen of claim 19 further comprising a plurality of screen openings in the main panel portion, and wherein the at least one screen centralizing peg is seated in at least one of the plurality of screen openings.

21. A urinal screen, comprising:

a urinal screen panel sized and configured for placement in a restroom urinal, the urinal screen panel including:

a main panel portion having a main panel portion edge and a panel center of gravity; and a flexible and deformable lift strap portion carried by the main panel portion, the left strap portion having:

a generally straight front strap portion segment;

a pair of generally curved side strap portion segments extending from the front strap portion, the side strap portions extending in a continuous and uninterrupted transition from the main panel portion;

a panel slot extending through the urinal screen panel, the panel slot separating the front strap portion segment and the side strap portion segments of the lift strap portion from the main panel portion and having a front slot segment, a pair of side slot segments generally adjacent and parallel to the front strap portion segment and the side strap portion segments, respectively, of the lift strap portion and a pair of slot ends terminating the pair of side slot segments, respectively; and the slot ends of the panel slot are substantially collinear with the panel center of gravity of the main panel portion;

a single-stranded, self-standing screen lift handle upward-standing from the front strap portion segment of the lift strap portion of the urinal screen panel; and the main panel portion of the urinal screen panel deployed from a generally flat, planar configuration to a generally concave, scoop-shaped configuration upon lifting of the main panel portion using the screen lift handle.

22. The urinal screen of claim 21 wherein the screen lift handle has a long axis disposed in generally perpendicular relationship to a plane of the urinal screen panel.

23. The urinal screen of claim 21 further comprising at least one screen centralizing peg carried by the main panel portion of the urinal screen panel.

24. The urinal screen of claim 23 further comprising a plurality of screen openings in the main panel portion, and wherein the at least one screen centralizing peg is seated in at least one of the plurality of screen openings.

25. A urinal screen, comprising:

a urinal screen panel sized and configured for placement in a restroom urinal, the urinal screen panel having a main panel portion; and a single, flexible and deformable lift strap portion carried by the main panel portion of the urinal screen panel, the lift strap portion having a front strap portion segment and a pair of side strap portion segments extending from the front strap portion segment and terminating at the main panel portion.

26. The urinal screen of claim 1 wherein the side strap portion segments of the lift strap portion are integrally formed in one piece with the main panel portion of the urinal screen panel.

27. The urinal screen of claim 1 wherein the main panel portion of the urinal screen panel comprises a main panel portion edge, and the lift strap portion is adjacent to the main panel portion edge.

* * * * *